US006554028B2

(12) United States Patent
Månsson

(10) Patent No.: US 6,554,028 B2
(45) Date of Patent: Apr. 29, 2003

(54) WEAVING OR TEXTILE MACHINE AND PROCESS FOR SUCH A MACHINE

(75) Inventor: Jan-Erik Månsson, Killeberg (SE)

(73) Assignee: Texo AB, Almhult (SE)

( * ) Notice: Subject to any disclaimer, the term of this patent is extended or adjusted under 35 U.S.C. 154(b) by 0 days.

(21) Appl. No.: 09/732,868

(22) Filed: Dec. 11, 2000

(65) Prior Publication Data

US 2001/0003994 A1 Jun. 21, 2001

(30) Foreign Application Priority Data

Dec. 9, 1999 (SE) ..... 9904485

(51) Int. Cl.[7] ..... D03D 41/00
(52) U.S. Cl. ..... 139/1 R; 139/11
(58) Field of Search ..... 139/1 R, 11

(56) References Cited

U.S. PATENT DOCUMENTS 4,757,842 A * 7/1988 Honegger et al. ..... 139/1 R
5,234,754 A * 8/1993 Bache ..... 428/332
5,611,974 A * 3/1997 Welch et al. ..... 264/34

FOREIGN PATENT DOCUMENTS

DE 3828395 A * 2/1990 ..... B02C/18/20
JP 2000145193 A * 5/2000 ..... E04H/9/02

* cited by examiner

*Primary Examiner*—John J. Calvert
*Assistant Examiner*—Robert H. Muromoto
(74) *Attorney, Agent, or Firm*—Connolly Bove Lodge & Hutz, LLP; Larry J. Hume

(57) ABSTRACT

A weaving or textile machine is provided that has a beamed (20, 21, 22 and 23) base (2) and moving parts, wherein the moving parts, during weaving, cause vibrations (18, 19) which spread to the base (2), and wherein that the beams are joined by or by means of a vibration-absorbing and dimensionally rigid compound (26), which prevents substantial spreading of the vibrations to a foundation (35) supporting the machine (1).

30 Claims, 3 Drawing Sheets

WEAVING OR TEXTILE MACHINE AND PROCESS FOR SUCH A MACHINE

TECHNICAL FIELD

The present invention relates to a weaving and textile machine of considerable weight and having a beamed base and moving parts, which moving parts, during weaving or product manufacturing, cause vibrations which spread to the base. By considerable weight can here be meant weaving machine weights in the order of magnitude of ca. 50 tonnes or more. In this context, reference can be made to the weaving machines for wire weaving which are generally available from TEXO AB, SE and have the model specifications TM 300 and TM 400. The said weave widths can range from, for example, 8 meters to close to ca. 30 meters. The moving parts in question can be constituted by the reed arrangement, the shaft frame arrangement, the drive arrangement, etc., which cause strong vibrations during weaving. Inter alia, the reed arrangement gives rise to strong vibrations when, during weaving, it bangs into the established edge in the woven material. The invention also relates to a process for a machine of the said type.

PRIOR ART

It is previously known per se to use iron and steel beams in heavy weaving machine bases. It is also known that the vibrations which are generated by the said motions in the weaving machine spread to the foundation (the floor) on which the weaving machine is erected. It is possible per se to try to prevent the spread of vibrations by increasing the dimensions in the beam construction, which does not however fully solve the problem in question and, moreover, adds substantially to the cost of the construction. In order to solve the problem of the transfer of vibrations to the foundation, it has been proposed, inter alia, to make a hole or recess in the foundation which is greater than the horizontal section of the base and thereafter to surround the parts sunk into the foundation with silicone compound or some other ductile arrangement which will help to prevent the spread of vibrations.

BRIEF DESCRIPTION OF THE INVENTION TECHNICAL PROBLEM

The making of holes in the foundation delays the installation work for the weaving machine or equivalent and the said installation work has to be planned long in advance. The making of holes as such means also that impurities in the form of stone dust and other flooring support spreads within the particular room and can be difficult to remove completely. In this context, It should be noted that there are stringent cleanliness requirements in weaving machine sheds and that a necessarily clean atmosphere is difficult and awkward to bring about after holes have been made in this way in the floor support. The invention sets out to solve this problem, inter alia.

It is also desirable for the heavy weaving machine in question to be erected/installed directly on a floor or foundation without the need to carry out alterations on the same. The invention solves this problem also.

There is also a need to have a substantially eliminated spread of vibrations to a foundation on which the machine stands, using technically simple and yet effective means. The invention solves this problem also.

It is also desirable for the mounting of the base and the machine in the particular weaving shed to be able to be realized section by section and for the various sections or blocks (viewed in the transverse direction of the machine) to be able to be put together with no adverse effect upon the foundation. The invention solves this problem also.

It is also desirable to be able to use the new base construction on already installed machines and to be able in these to prevent or substantially deter the spreading of vibrations from the moving parts of the machine to a machine foundation in question. The invention solves this problem also.

THE SOLUTION

What primarily can be considered to be characteristic of the new weaving and textile machine is that its base beams are joined by or by means of a vibration-absorbing, dimensionally rigid compound, which, together with the beams, prevents substantial spreading of the aforementioned vibrations to a foundation supporting the weaving machine.

The compound can be constituted preferably by concrete, for example polymer-reinforced concrete. The concrete or equivalent is preferably reinforced with reinforcing iron in a manner which is known per se. In the case, especially, of wider weaving machines of the present type, the base, viewed in the transverse direction of the machine, can be divided into a number of parts. In the case, for example, of 16 meter wide weaving machines, the base can consist of three blocks or segments which can be put together by means of a suitable joint, for example a casting joint, screw joint, welded joint, etc. The dimensionally rigid compound/concrete in question fills the space between the base beams in question along preferably the whole of the transverse extent of the weaving machine. The invention can also however function in cases where not the whole of the said space is filled with the dimensionally rigid compound in question. However, at least 20% of the transverse extent in question must be provided with the dimensional rigid compound. In preferred embodiments, at least 80% of the space in question between the beams is provided with the dimensionally rigid compound. The dimensionally rigid compound has vertical extents in the base which are related to the heights of the beams in question. The base can be constructed with I-beams and U-beams which extend along the whole of the transverse extent of the weaving machine or parts of the transverse extent, it also being possible for the beams to have different extents in the said transverse direction. In that case, the I-beams form outer beams and the U-beams form inner beams, by means of which inner beams an embedding in the casting material of the base can be arranged. The dimensionally rigid compound here extends in the full vertical extents of the I-beams. In alternative embodiments, the dimensionally rigid compound/concrete can extend over or occupy ca. 80% of the height of the beams in question. The dimensionally rigid compound extends on the outsides of the inner U-beams to 100% or to at least 80%. The dimensionally rigid compound in question can be supplied in a quantity which, together with the reinforcement/reinforcing iron in question, constitutes a weight which is 10–30%, preferably ca. 20%, of the total weight of the weaving machine.

The new process according to the invention is principally characterized in that the beams of the base are erected on a first foundation which demarcates a first space between the beams from a foundation, and in that a vibration-absorbing and dimensionally rigid compound is applied in the whole or parts of the said first space.

In one embodiment, a second space is arranged in the first space with the aid of longitudinal inner beams (U-beams).

The second space is demarcated from the first space by means of a unit or board (plyfa board), the second space forming a compound-free space. In connection with the making of the base, the said beams are mutually fixed, prior to the filling of compound, by the use of a fixture. The first space is reinforced with reinforcing iron and the compound in the form of concrete, for example polymer-reinforced concrete, is applied in the first space. The base can be prefabricated in one or more block(s). In the case of a plurality of blocks, for example three blocks, these are mutually put together using a suitable type of joint, e.g. casting joint,. screw joint, welded joint.

ADVANTAGES

As a result of the above-proposed, the beams and the dimensionally rigid compound/concrete can be considered to form one or more dimensionally rigid and vibration-absorbing bodies. The base, together with the cast-together beams, can be regarded as a barrier against the spreading of vibrations to the foundation of the machine and as a vibration-absorbing body. Where there are a plurality of bodies, these can be prefabricated or produced in situ and assembled according to the above. The described solution gives an economically advantageous construction which, moreover, is intrinsically tried and tested and comprises technically simple means. Solutions involving larger dimensions of the beams of the base can hereupon be eliminated, as well as all proposals for making holes in the floor and insulation attempts using silicone compounds and the like. The beams in the base can be mutually rigged with relative ease using reinforcing iron and relatively simple fixtures. In the casting process, plyfa boards can be easily adjusted to the form spaces and in the casting material it is easy, in a manner which is known per se, to arrange ducts for wiring, components and other requirements.

DESCRIPTION OF THE FIGURES

Currently proposed embodiments of a weaving machine and a process relating thereto will be described below with simultaneous reference to the appended drawings, in which.

DETAILED EMBODIMENT

Figure 1:
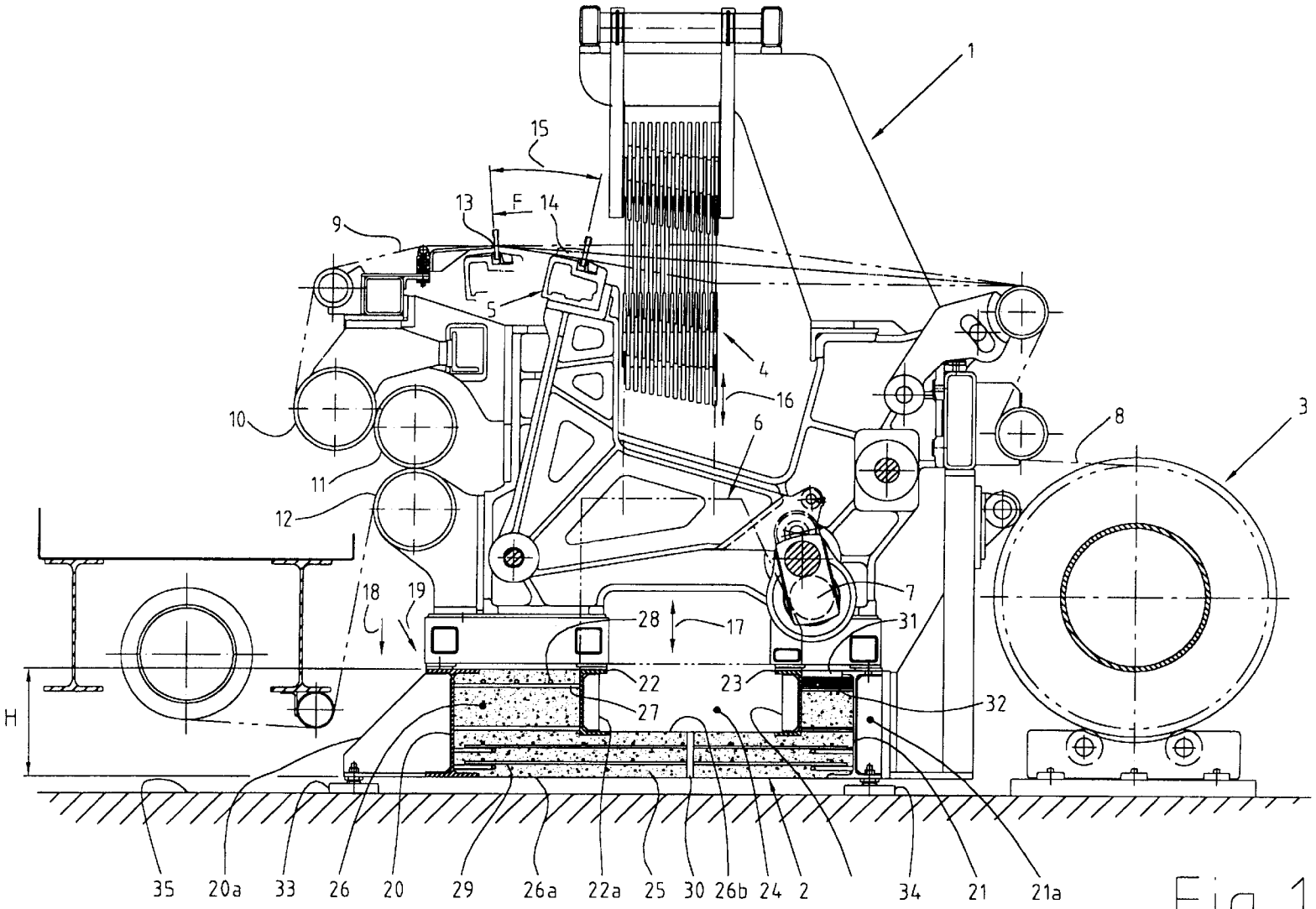
FIG. 1 shows in partial longitudinal section and in basic representation a weaving machine having a base of iron or steel beams which are mutually connected with reinforced concrete and having moving parts which generate vibrations against the base, the weaving machine being erected on a flat foundation/floor.

In FIG. 1, the silhouette of a weaving and textile machine which can be provided with a base 2 of the present type is denoted by 1. The machine is of the type which has considerable weight and weighs, for example, 50 tonnes or more. In the illustrative embodiment, the weaving machine is constituted by a so-called flat-weaving machine, by means of which material in the form of wire cloth is woven for the paper industry. In a known manner, the weaving machine comprises a warp thread magazine 3, a shaft frame arrangement 4, and a reed arrangement 5. The machine can be of the type which has a length of 8–30 meters, whence it will be realized that fabrics/wire cloths of considerable width and length are woven by means of the weaving machine. The machine can also comprise, in a known manner, a shaft frame machine 6 and drive members 7. In the figure, the warp is indicated by 8 and the woven material by 9. The woven material is collected in a manner which is known per se on drums or like magazines. In the warp thread webs, tubes or drums 10, 11 and 12 are arranged in a manner which is known per se. A weave edge in the woven material is symbolized by 13 and one or more shuttles for weft threads are symbolized by 14.

It will be realized that, during weaving by means of the weaving machine 1 indicated in FIG. 1, appreciable vibrations are generated in connection with the weaving. Thus, for example, the reed arrangement is suspended asymmetrically and bangs into the weave edge 13 with great force F. The motions for the reed arrangement are indicated in the figure by the arrows 15. The shaft frame arrangement 4 is controlled by means of the shaft frame machine 6 and the motions of the shaft frames are symbolized by 16 and the interaction of the shaft frame machine with the shaft frames is symbolized by 17. The motions in the said large and heavy components result in vibrations 18, 19 spreading down to the base 2.

According to FIG. 1, the base comprises two outer beams in the form of two I-beams 20, 21. These I-beams extend in the transverse direction of the weaving machine, i.e. perpendicular to the paper plane. The beams can be undivided or divided along the transverse direction of the weaving machine, the division being able to be realized such that the I-beams consist of two or more I-beams extending in the transverse direction, which are joined in a manner which is known per se. The number of I-beams joined in this way is dependent upon the width of the weaving machine. The weaving machine additionally comprises two U-beams 22, 23, which also extend in the transverse direction of the weaving machine and can be divided or undivided according to the said I-beams. With the aid of the said U-beams, a space 24 recessed in the base is formed, which can be used as a cable channel and/or can be allocated other functions. Between the said beam arrangements there is therefore a space 25, here referred to as the first space, the space 24 being designated as the second space. The beams are connected one to the other by means of a dimensionally rigid compound 26 disposed in the said first space. The compound 26 in question is preferably constituted by concrete of a type which is known per se and which, in an illustrative embodiment, can be constituted by so-called polymer-reinforced concrete. The concrete is reinforced with reinforcing iron or welded mesh reinforcement 27, 28 and 29. In the compound, holes 30 may be arranged for possible underpouring. The said holes are distributed in the transverse direction of the weaving machine or the base at a spacing, for example, of 2 m. The base can also comprise a slab 31 for a drive gearbox. Should through-ducts for drills and screw taps be desired, continuous holes can be arranged using polystyrene 32 or the like. The beams have stiffening parts 20*a*, 21*a*, 22*a*, 23*a* arranged evenly spaced along the transverse direction of the weaving machine. The weaving machine or the base can be provided with foot parts 33, 34 by which the machine rests upon a floor or foundation 35. The compound preferably fills the space to 100% or essentially 100%.

The above-described arrangement thus comprises a dimensionally rigid compound, preferably comprising reinforced concrete, which forms a barrier for the vibrations 18, 19 so that these are prevented from spreading into the floor foundation 35. In the illustrative embodiment, the dimensionally rigid compound extends along the whole of the transverse direction of the weaving machine. The casting material has set firmly to the beam materials and the height H of the casting material corresponds to the height of the said I-beams, on the whole of the insides of which the concrete 26 has set firmly. In the illustrative embodiment, the casting material 26 extends also along the whole of the outsides of the U-beams and the concrete has set firmly to the said outsides of the beams and to the outside of the lower limbs of the U-beams.

As an example of a concrete compound can be cited a composition of concrete STD 2 K 40 with max. 8 mm stone. Calculated volume per section (in the case of three blocks or segments) is in the present case 1.5 $m^3$, which means in total that the base is provided with 4.5 $m^3$ concrete compound.

The reinforcing iron meshes are arranged on four storeys, a first reinforcing iron mesh being situated on the lower limbs of the I-beams, a second reinforcing iron mesh being arranged between a bottom surface 26*a* of the casting material and a top surface (constituting the bottom surface of the said second recess 24) 26*b*. The third and fourth reinforcing iron meshes are arranged between the I-beams and the U-beams and bear against the insides of the I-beams and the outsides of the U-beams.

Figure 2:
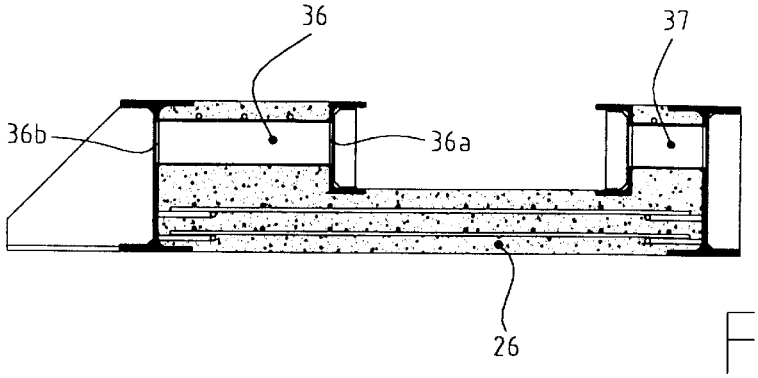
FIG. 2 shows in cross section the base according to FIG. 1.

According to FIG. 2, it will be realized that the casting material 26 can be provided with continuous holes 36, 37 for cabling or the like. The section according to FIG. 2 constitutes a cross section other than that which is shown in FIG. 1. In the present case, the said holes 36, 37 extend horizontally, but it is clear that other extents can be arranged for the said holes. The holes are distributed in the transverse direction of the weaving machine or the base with a chosen distance between them. The holes can emerge in the I-beams and/or the U-beams, in the illustrative embodiment shown in FIG. 2, a recess in the U-beam having been indicated by 36*a* and a recess in the I-beam having been indicated by 36*b*.

Figure 3:
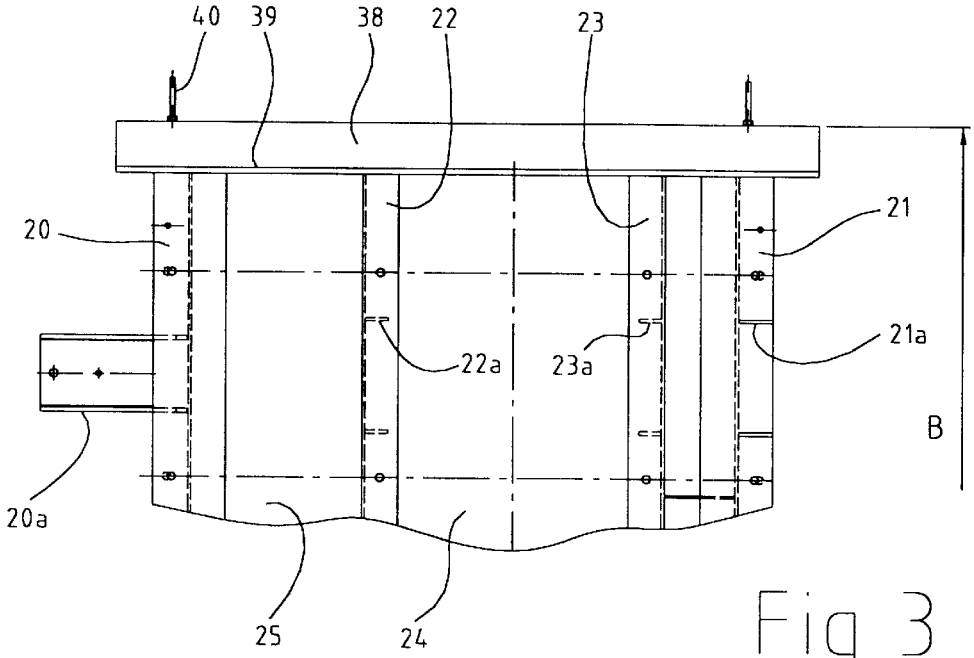
FIG. 3 shows in horizontal view parts of the base according to FIGS. 1 and 2.

In FIG. 3 is shown a base or a base part during construction. The extents of the I and U-beams 20, 21 and 22, 23 respectively in the transverse direction B of the weaving machine are indicated in the figure, as are the supporting parts 20*a*, 21*a*, 22*a* and 23*a*. In FIG. 3, the first space is denoted by 25. In connection with the application of the casting material, a crossbar 38 and a plyfa board 39 are used. Likewise, a screw connection is indicated by 40. In the illustrative embodiment in question, three base blocks can be made, cable ducts being able to be arranged in the outer ends of the outer blocks or segments. The junction box of the weaving machine can be placed outside the outer ends and cables can be drawn in the middle channel constituted by the second space 24. In connection with the making of the base, care is taken to ensure that bearing plates and beams lie on a flat and horizontal foundation. Crossbars which hold the beams in the correct position are screwed firmly in place in the foundation in question. The ends of the formwork which has thereby been formed are precisely levelled and the end faces sealed with plyfa boards 39, which are reinforced with the said crossbars. Holes can be drilled in the beams for fastening the end faces. When casting material or concrete is applied, then this must be vibrated during casting.

Figure 4:
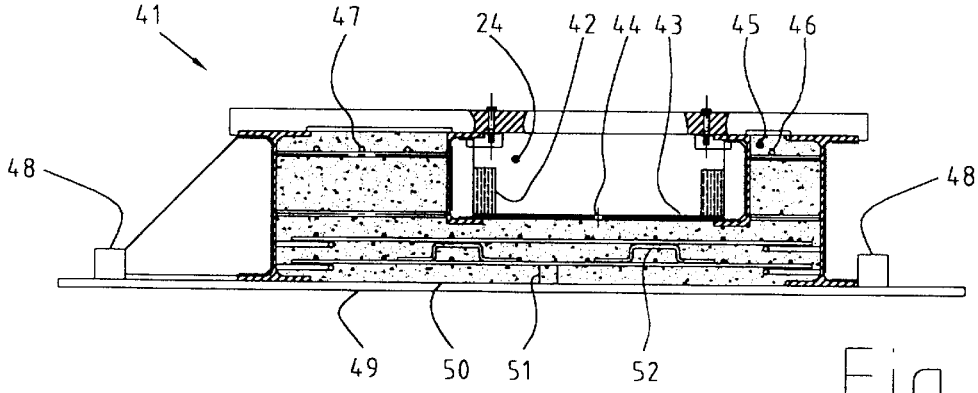
FIG. 4 shows a cross section of the base according to FIGS. 1, 2 and 3 during construction.

FIG. 4 also shows the construction process for a base according to the invention. In this, a fixture 41 is used to hold the beams in the correct position. The fixtures are made from steel and measure 60×30 mm and are six in number. In this connection, crossbars 42 are also used, for example measuring 50×100 mm or the like, in order to hold utilized plyfa boards 43 in position during casting. The crossbars are anchored in the beams. In addition, holes 44, for example of 15 mm diameter, are arranged to allow air to escape during casting. A space or a place for vibrator bar (not shown) which is used during casting is denoted by 45. The reinforcing irons 46, 47 in connection with a particular part of the space can have a diameter of 12 mm and are used in suitable number. On the other side of the U-beams, reinforcing irons of 12 mm diameter can be used, which reinforcing irons are tied firmly in place. A supporting crossbar is indicated by 48. The supporting crossbar or supporting crossbars can be made of iron or wood and hold the beams in place on both sides. The beams are erected, prior to casting, on a plyfa board 49, which can be 18 mm thick and which therefore forms the bottom in the formwork. A plastics film is laid on the top surface of the plyfa board prior to the application of the casting material. This plastics film or plastics foil is indicated by 50. In addition, a plastics support 51 is used to hold the reinforcement at the correct level in connection with the filling of concrete or equivalent. Reinforcing iron stirrups 52, for example of 8 mm diameter, are used to hold the reinforcing iron of the second storey in place. The iron stirrups are tied firmly in place. In an illustrative embodiment, the base or the base block has a width of 1620 mm. The distance between the outer ends of the I-beams can measure ca. 1370 mm. The second recess 24 can have a length of ca. 510 mm.

Figure 5:
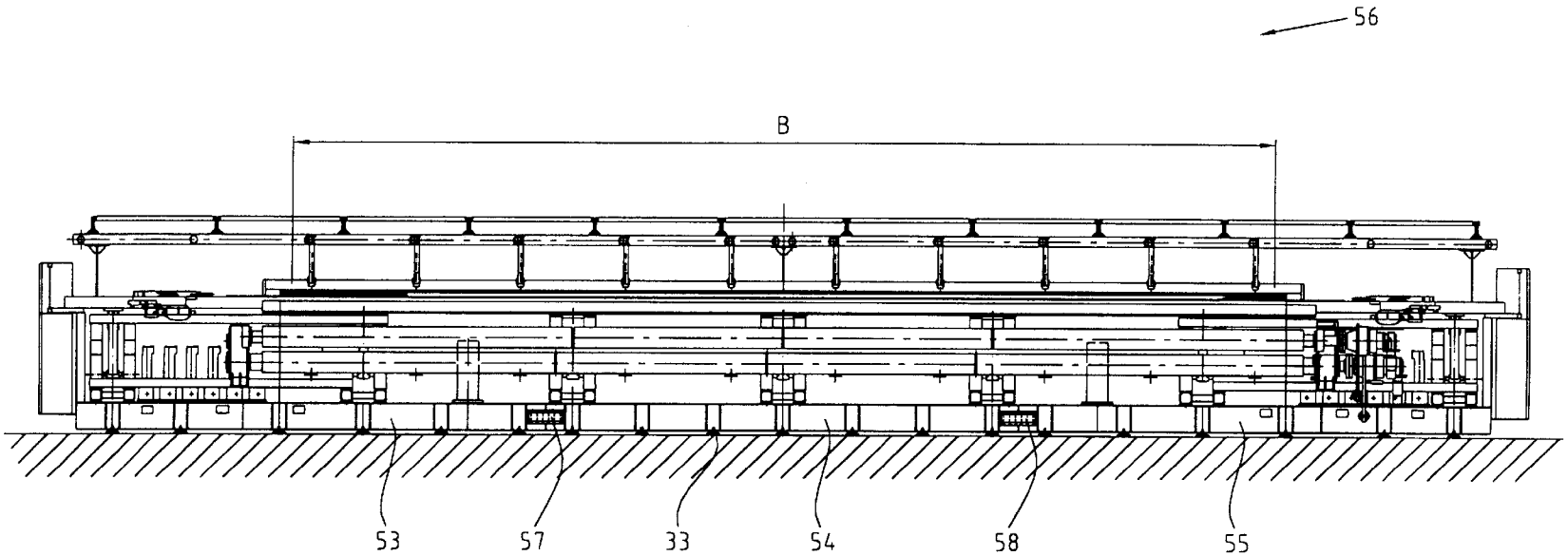
FIG. 5 shows from the front and in basic representation a weaving machine having a base which is made up of blocks or segments.

In FIG. 5, the width of the weaving machine is denoted by B. In connection with installation or mounting in a weaving machine shed, three base blocks 53, 54 and 55 are set up or arranged one behind the other. The weaving machine shed has been symbolized by 56. The said base blocks are connected at their junctions 57 and 58 by means of a suitable joint, which can be constituted by a casting joint, screw joint, etc. The blocks are provided with foot parts 33, by means of which the blocks can be adjusted in the horizontal direction. The compound can alternatively be formed of sand and/or another material which has been bound with an agent offering the said dimensional rigidity.

The invention is not limited to the embodiment shown by way of example above, but can be subject to modifications within the scope of subsequent patent claims and the inventive concept.

What is claimed is:

1. A weaving or textile machine of considerable weight of at least about 50 tons and having moving parts therein, the machine comprising:

a base including beams arranged across a width of the machine, said moving parts, during weaving, causing vibrations which spread to the base; and a vibration-absorbing and dimensionally rigid compound located in a space between the beams, wherein the space is arranged across essentially the entire width of the machine, said compound preventing a substantial spreading of the vibrations to a foundation supporting the machine.

2. Machine according to claim 1, wherein the compound comprises concrete.

3. Machine according to claim 2, wherein the concrete is reinforced with reinforcing iron.

4. Machine according to claim 2, wherein the concrete is polymer-reinforced.

5. Machine according to claim 1, wherein the machine is capable of being erected directly on a floor foundation via the base of the machine.

6. Machine according to claim 1, wherein the base, viewed in the transverse direction of the base, is divided into a number of parts or blocks.

7. Machine according to claim 1, wherein the beams of the base are cast together with the compound in at least 20% of the transverse extent of the base.

8. Machine according to claim 1, wherein the compound has a weight which is in the range of 10–30% of a total weight of the machine.

9. Machine according to claim 1, wherein the casting material has a vertical extent which is at least 80% of a vertical extent of the beams.

10. A process for installing a weaving or textile machine of considerable weight of at least about 50 tons and having a beamed base comprising beams, and moving parts which, during weaving or product manufacturing, cause vibrations which spread against or to the base, the process comprising:

erecting the beams across a width of the machine on a first foundation; and applying a vibration-absorbing and dimensionally rigid compound in at least a portion of a first space defined by the first foundation and the beams, wherein the first space is arranged across essentially the entire width of the machine.

11. Process according to claim 10, further comprising:

arranging a second space within the first space, said second space being defined by longitudinal inner beams and a unit or board which demarcates the second space from the first space; and ensuring that the second space is a compound-free space.

12. Process according to claim 10, further comprising mutually fixing the beams with a fixture prior to said applying the vibration-absorbing and dimensionally rigid compound.

13. Process according to claim 10, further comprising:

providing the first space with reinforcing iron; and applying a concrete compound in the first space.

14. Process according to claim 10, further comprising producing and connecting together, when viewed in the transverse direction of the base, a plurality of base segments or base blocks.

15. Process according to claim 14, further comprising prefabricating the base segments or base blocks and transporting the base segments or base blocks to an erection site.

16. Machine according to claim 3, wherein the concrete is polymer-reinforced.

17. Machine according to claim 2, wherein the machine is capable of being erected directly on a floor foundation via the base of the machine.

18. Machine according to claim 3, wherein the machine is cable of being erected directly on a floor foundation via the base of the machine.

19. Machine according to claim 4, wherein the machine is capable of being erected directly on a floor foundation via the base of the machine.

20. Machine according to claim 2, wherein the base, viewed in the transverse direction of the base, is divided into a number of parts or blocks.

21. Machine according to claim 1, wherein the weight is greater than 50 tons.

22. Machine according to claim 3, wherein the number of parts or blocks is three.

23. Machine according to claim 8, wherein the weight of the compound is approximately 20% of the total weight of the machine.

24. Process according to claim 10, further comprising supporting a weight of the weaving or textile machine of greater than 50 tons.

25. Machine according to claim 20, wherein the number of parts or blocks is three.

26. A weaving or textile machine of considerable weight and having moving parts therein, the machine comprising:

a base including beams arranged across a width of the machine, said moving parts, during weaving, causing vibrations which spread to the base; and a vibration-absorbing and dimensionally rigid compound comprising concrete located in a space between the beams, said compound preventing a substantial spreading of the vibrations to a foundation supporting the machine and being reinforced with both a polymer and reinforcing iron, wherein the machine is capable of being erected directly on a floor foundation via the base of the machine, wherein the base, viewed in a transverse direction of the base, is divided into a number of blocks, wherein the beams of the base are cast together with the compound in at least 20% of a transverse extent of the base, and wherein the casting material has a vertical extent which is at least 80% of a vertical extent of the beams.

27. A process for installing a weaving or textile machine of considerable weight and having a beamed base comprising beams and moving parts which, during weaving or product manufacturing, cause vibrations which spread against or to the base, the process comprising:

erecting the beams across a width of the machine on a first foundation;

applying a vibration-absorbing and dimensionally rigid compound in at least a portion of a first space defined by the first foundation and the beams;

arranging a second space within the first space, said second space being defined by longitudinal inner beams and a unit or board which demarcates the second space from the first space;

ensuring that the second space is a compound-free space;

mutually fixing the beams with a fixture prior to said applying the vibration-absorbing and dimensionally rigid compound;

providing the first space with reinforcing iron;

applying a concrete compound in the first space;

producing and connecting together, when viewed in the transverse direction of the base, a plurality of base segments or base blocks;

prefabricating the base segments or base blocks and transporting the base segments or base blocks to an erection site, wherein the machine is capable of being erected directly on a floor foundation via the base of the machine, wherein the weight is 50 tons or more, and wherein the weight of the compound is approximately 20% of the total weight of the machine.

28. The weaving or textile machine of claim 1, wherein the width of the machine is at least 8 meters.

29. The process according to claim 10, wherein the width of the machine is at least 8 meters.

30. The weaving or textile machine of claim 26, wherein the weight is at least about 50 tons.

* * * * *